United States Patent [19]

Potter

[11] 3,951,090

[45] Apr. 20, 1976

[54] HYDRAULIC SYSTEM FOR RAISING AND LOWERING KEEL

[75] Inventor: John T. Potter, Locust Valley, N.Y.

[73] Assignee: Potter Instrument Company, Inc., Plainview, N.Y.

[22] Filed: Nov. 8, 1974

[21] Appl. No.: 522,223

Related U.S. Application Data

[63] Continuation-in-part of Ser. No. 420,864, Dec. 3, 1973, abandoned, which is a continuation-in-part of Ser. No. 279,836, Aug. 11, 1972, abandoned.

[52] U.S. Cl. ..... 114/141; 114/132; 115/41 HT

[51] Int. Cl.[2] ..... B63B 41/00

[58] Field of Search ..... 114/140, 141, 127, 132, 114/130, 139, 165, 171, 66.5 P; 115/41 HT; 60/413, 372, 403, 404

[56] References Cited

UNITED STATES PATENTS

| | | | |
|---|---|---|---|
| 667,158 | 1/1901 | Webster | 114/138 |
| 3,587,513 | 6/1971 | Stimatze | 115/41 HT |
| 3,717,995 | 2/1973 | Case | 60/413 X |
| 3,722,455 | 3/1973 | Carpenter | 115/41 HT |

*Primary Examiner*—Trygve M. Blix
*Assistant Examiner*—Gregory W. O'Connor
*Attorney, Agent, or Firm*—Lane, Aitken, Dunner & Ziems

[57] ABSTRACT

The hydraulic system for raising and lowering a heavy keel comprises a cylinder, a piston movable in the cylinder and connected to the keel, and an accumulator for supplying hydraulic fluid at a positive pressure below that necessary to raise the keel against the piston in a direction for raising the keel. A hand pump is provided for supplying hydraulic fluid at a pressure great enough to overcome the weight of the keel. A valve allows the hydraulic fluid to flow either to or from the cylinder. An enlarged flow line communicates the accumulator with the cylinder so that if an external force should cause the keel to raise suddenly, hydraulic fluid would flow rapidly beneath the piston. A gas is provided on the other end of the piston for providing a cushioning effect and restricting the speed at which the keel can be raised. A restricted flow valve is provided in the system for regulating the speed at which the keel can be lowered.

8 Claims, 1 Drawing Figure

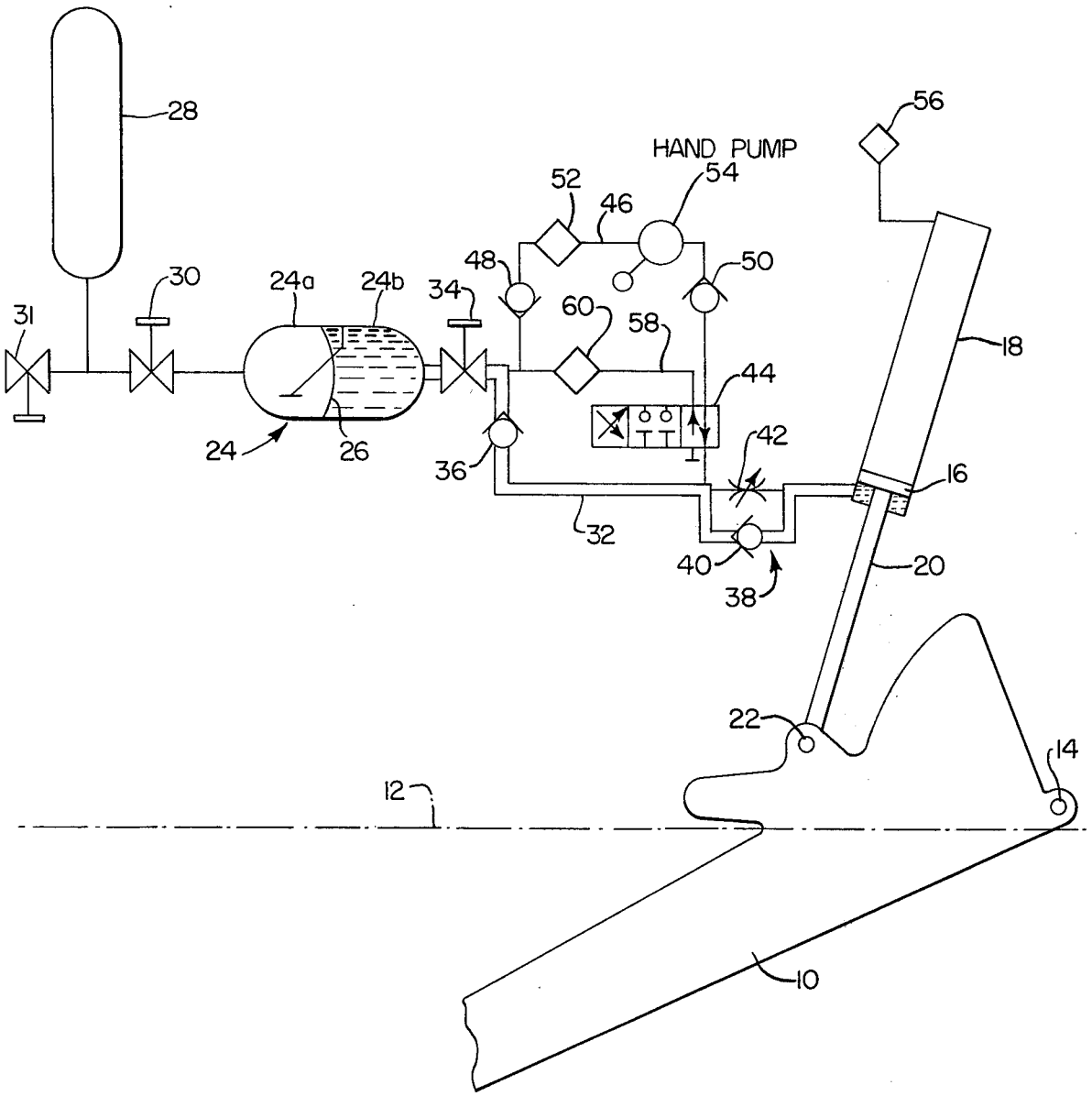
28
HAND PUMP
54
52
46
56
48
50
30
24a
24b
34
31
60
58
18
44
24
26
36
42
16
32
40
20
38
22
14
12
10

HYDRAULIC SYSTEM FOR RAISING AND LOWERING KEEL

This application is a continuation-in-part of and contains subject matter in common with my U.S. application Ser. No. 420,864, filed Dec. 3, 1973, now abandoned and which was a continuation-in-part of my U.S. application Ser. No. 279,836, filed Aug. 11, 1972, now abandoned.

BACKGROUND OF THE INVENTION

This invention relates to hydraulic systems and more specifically to a hydraulic system for raising and lowering the keel of a sailboat that can be used for racing.

Most sailboats have a weighted centerboard, i.e., a keel, to provide the boat with needed stability and to resist lateral movement leeward. Since a keel tends to be relatively large in size, provision should be made to retract it, normally into a well located in the underneath side of the hull when the boat is sailing in shoal waters or with the wind. When the keel is in its raised position, the sailboat will move much faster through the water than when the keel was lowered because of the higher center of gravity and lesser water resistance when the keel is raised. However, when sailing on the wind, for example, the keel must be lowered to reduce the boat's natural tendency to drift.

During a race, it is essential to be able to raise and lower the keel as quickly as possible. Even a delay of several seconds during offensive or defensive maneuvers in close quarters or during a change in course can prevent the boat from attaining an advantageous wind position and affect the outcome of a race. However, in a racing sailboat these operations, according to the rules, must be accomplished without power which in the past has proved to be strenuous and time consuming, especially when considering how often the keel must be raised and lowered during a race. Accordingly, it is advantageous to reduce the amount of work required to raise and lower the keel, providing the speed of raising and lowering is not sacrificed and the rules are not broken.

Furthermore, the keel should be able to retract or move upward if it should strike a submerged rock, underwater surface or other obstruction so that the boat is not damaged due to the keel resisting movement toward the hull. However, this movement must be cushioned to prevent the keel from smashing into the hull, especially if the boat should capsize. The tendency of the keel to slam back toward its lowered position after disengaging such an obstruction or turning upright should also be prevented.

SUMMARY OF THE INVENTION

There is provided in accordance with the invention a hydraulic system that solves the problems discussed above. More specifically, the inventive system reduces the manual effort required to raise a sailboat keel and provides a cushion against precipitous movement of the keel in both directions.

This is accomplished in part by connecting an accumulator to the side of a piston that is used to raise the heavy keel. The accumulator is set so that it applies fluid pressure to that side of the piston at a level less than that required to lift the keel. A hand pump is provided to supply the additional fluid pressure that is needed to raise the keel. This arrangement enables the keel to be raised in such a way as to reduce significantly the amount of work expended during each raising operation, and at the same time meet the rule requirement of not using an outside power source. The keel can easily be lowered by reversing the main valve and allowing gravity to act on the heavy weight of the keel. An adjustable flow valve is provided to prevent the keel from falling too rapidly by throttling the flow of hydraulic fluid from the cylinder.

A cushioned resistance to upward movement of the keel (when it is in the lowered position) is provided by utilizing a gaseous fluid on the other side of the piston. Since a gas is more compressible than a liquid, if the keel should strike an obstruction, the keel would be able to undergo a limited upward movement upon impact. The gas could be vented to the atmosphere or to a reservoir through a controlled orifice to enable the keel to move toward the hull at a predetermined limited rate of speed. This would prevent the keel from slamming into the hull.

A second fluid line between the accumulator and piston can be provided to supply hydraulic fluid to the piston when the keel is raised as a result of such an impact. This line should be significantly enlarged to allow the fluid quickly to fill the void created on the underside of the piston, so that when the keel disengages from the obstruction, it will encounter resistance to downward movement (because of the adjustable flow valve) and move normally toward its lower position without slamming down.

BRIEF DESCRIPTION OF THE DRAWING

For a better understanding of the invention, reference may be had to the following description of a preferred embodiment, taken in conjunction with the accompanying drawing, in which:

FIG. 1 is a diagrammatic view of an embodiment of the inventive hydraulic system in which the keel is shown in its lowered position.

DETAILED DESCRIPTION OF AN EXEMPLARY EMBODIMENT

Referring now to FIG. 1, the embodiment of the inventive hydraulic system shown in the drawing will be described in conjunction with a retractable keel 10 (shown in its lowered position in the drawing) that is suitable for use on a sailboat. A portion of the hull of the boat is shown generally by the broken lines designated by reference numeral 12. When the keel 10 is in its retracted or raised position, it is stored in a well (not shown) in the bottom of the boat in a known manner.

The keel 10 is pivotally mounted on the hull of the boat at the pivot point 14 by suitable means so that the keel 10 can be pivoted about the pivot point 14 between its raised and lowered positions. The keel 10 is raised and lowered by the piston 16 which is slidably movable within the cylinder 18. The piston rod 20 connects the piston 16 to the keel 10 at the pivot point 22, and the keel 10 is designed, for example as shown in the drawing, so that it will not interfere with the up and down movement of the rod 20.

The system also includes an accumulator 24 which has two compartments **24*a* and 24*b* that are separated by a flexible gas-impervious diaphragm 26. A gas storage tank 28 is connected through the hand-operated valve 30 to the compartment 24*a* of the accumulator 24 so that gas under pressure can be supplied to the compartment 24*a* to exert a predetermined minimum pressure on hydraulic fluid in the compartment 24***b*. During operation of the system, the valve 30 is normally open so that the tank 28 and compartment 24*a* are in communication, although the accumulator can be designed so that such a valve is not open during operation. A valve 31 is provided on the other side of the tank 28 so that the tank 28 can be recharged when necessary.

As shown in FIG. 1, the keel 10 is in its lowered position and the operation of the system will first be described in conjunction with raising of the keel 10. As mentioned above, gas in the compartment 24*a* of the accumulator 24 exerts a predetermined pressure on hydraulic fluid located in compartment 24*b* of the accumulator 24. This pressure should be at a level that is somewhat less than that necessary to raise the keel 10. For example, when a 20,000 lb. keel is maintained in its lower position solely by means of gravity it has been found that about one-fourth of the vertical gravitational force vector is necessary for suitable operation of the system. If the vertical weight vector of the keel in the lower position is, for example, 15,700 lbs. then the net vertical weight required to maintain the keel in that position would be about 3,925 lbs. and the balance could be applied upwardly to the keel 10 by the accumulator 24. Therefore, the accumulator 24 and tank 28 can be set to impart a force equal to about three-fourths of the vertical weight vector of the keel 10 to the underside of the piston 16.

This force is continuously imparted against the underside of the piston 16 through the line 32 which includes the hand-operated valve 34 and one-way check valve 36. The line 32 is connected to the cylinder 18 through the valve 38 which is a valve known to the art that permits unrestricted flow in one direction and adjustably throttled flow in the other direction. As shown in FIG. 1, the valve 38 includes the check valve 40, which permits flow toward the cylinder 18, and the adjustably restricted flow portion 42 which can be set to allow the hydraulic fluid to flow back toward the accumulator only under a set predetermined flow rate.

As shown diagrammatically in FIG. 1, the line 32 is formed significantly larger than the other hydraulic lines in the system so that if the keel should strike an underwater obstruction and be rapidly raised (as will be described below) it will not then slam downward towards its lower position once the obstruction is cleared. The enlarged diameter of the line 32 permits the hydraulic fluid to rush into the void created beneath the piston 16 upon impact and form a cushion so that when the obstruction is cleared the keel 10 will move back toward its lowered position at its normal speed. By way of example, if all of the hydraulic lines of the system were ¼ inch diameter, the line 32 could be approximately 1½ inches to 2 inches in diameter.

When the keel 10 is to be raised, the valve 44 is switched to the position shown in FIG. 1 so that the line 46 communicates with the cylinder 18 through the valve 38. The line 46 includes the one-way check valves 48 and 50, the filter 52 and the hand-operated pump 54.

The hand pump 54 is used to supply the force required to overcome the weight of the keel 10 so that the combination of the forces imparted by the accumulator 24 and pump 54 will be sufficient to raise the keel 10.

As the keel 10 is raised, air or other suitable gas located in the cylinder 18 on the other side of the piston 16 is vented either to the atmosphere or to a reservoir (now shown) through the filter 56 and a restricted orifice (not shown). A gas is provided on the other side of the piston 16 so that should the keel 10 hit a submerged obstruction it will move upwardly against the cushioning effect of the gas and not remain rigid in its lowered position which could cause severe damage to the keel 10 and boat. Gas is provided in the upper portion of the cylinder because it is much more readily compressible than a liquid so that a better cushioning effect is provided for the keel 10.

When the keel 10 is in its raised position it will remain there until the valve 44 is switched from a neutral position to a position where the portion of the cylinder 18 under the piston 16 communicates with the line 58 to allow the hydraulic fluid to flow back into the compartment 24*b* of the accumulator 24. The line 58 includes the filter 60. Until the valve 44 is switched back to that position, the keel 10 will remain in its upper position because return of hydraulic fluid to the accumulator 24 is blocked by the check valves 40 and 36 and the valve 44. When the valve 44 is switched to lower the keel 10, valve 38 will prevent the keel 10 from dropping too fast because of the restricted flow through the restricted flow portion 42. It has been found that the weight of the keel 10 acting against the pressure exerted on the bottom of the position 16 by the accumulator 24 is sufficient to lower the keel at a suitable rate of speed for racing purposes.

Thus, when a system such as that described above and shown in FIG. 1 is provided the keel 10 will be able to move toward the hull if it should strike an obstruction. In addition, since the line 34 is of a diameter significantly larger than the other fluid lines in the system the space created under the piston 16 in response to a sudden upward movement would fill rapidly and thereby prevent the keel from slamming down once the obstruction is removed.

Should the sailboat capsize, the keel 10 is likewise cushioned by the gas in the upper portion of cylinder 18 and sudden movement toward the hull is prevented. Also, since hydraulic fluid will fill the space underneath the piston 16, once the boat is uprighted the keel will lower at a normal rate of speed and not slam down.

Furthermore, because the accumulator imparts a predetermined pressure against the lower portion of the piston 16 the operation of raising the keel is made much easier because the entire load represented by the heavy keel does not have to be overcome each time the keel is to be raised.

The embodiment of the invention described above is intented to be merely exemplary and those skilled in the art will be able to make modifications and variations on it without departing from the spirit and scope of the appended claims, all such modifications and variations being contemplated as falling within the scope of the claims.

I claim:

1. A hydraulic system for raising and lowering a heavy keel, comprising;

a cylinder;

a piston connected to the keel and operatively movable in the cylinder;

pressure means for supplying hydraulic fluid to the cylinder on the side of the piston for raising the keel, the fluid being at a positive pressure below that necessary to raise the keel;

pump means for supplying hydraulic fluid to said side of the piston at a pressure great enough to raise the keel;

means for allowing hydraulic fluid to flow from the pressure means to the cylinder should an external force cause the keel to move toward the raised position;

valve means for selectively preventing the flow of hydraulic fluid from the cylinder on said side of the piston when the keel is away from its lowered position so that the keel can be prevented from moving toward the lowered position;

first regulating means for regulating the speed at which the keel can move toward the lowered position, and;

second regulating means for regulating the speed at which the keel can move toward the raised position;

wherein the pressure means is an accumulator with two reciprocally expandable and contractable compartments therein formed with a gas-impervious diaphragm therebetween, one of said compartments being adapted to contain gas under pressure and the other being adapted to contain said hydraulic fluid.

2. The system in claim 1, wherein the means for allowing includes a first flow line between the pressure means and the cylinder.

3. The system in claim 1, and further including a second flow line between the pressure means and the cylinder, the pump means being included in the second flow line.

4. The system in claim 3, and further including a third flow line between the pressure means and the cylinder, the second and third flow lines cooperating with the valve means so that hydraulic fluid will selectively be able to flow from the pressure means and pump means into the cylinder through the second line means and from the cylinder to the pressure means through the third line means.

5. The system in claim 4, wherein the means for allowing includes the first line means being significantly larger in cross-section than the second and third line means.

6. The system in claim 1, wherein the first regulating means includes a valve which includes a check-valve means for allowing unrestricted flow of hydraulic fluid toward the cylinder and throttling means for adjustably restricting the flow of hydraulic fluid from the cylinder.

7. The system in claim 1, wherein the pump means includes a hand-operable pump.

8. A hydraulic system for raising and lowering a heavy keel, comprising;

a cylinder;

a piston connected to the keel and operatively movable in the cylinder;

pressure means for supplying hydraulic fluid to the cylinder on the side of the piston for raising the keel, the fluid being at a positive pressure below that necessary to raise the keel;

pump means for supplying hydraulic fluid to said side of the piston at a pressure great enough to raise the keel;

means for allowing hydraulic fluid to flow from the pressure means to the cylinder should an external force cause the keel to move toward the raised position;

valve means for selectively preventing the flow of hydraulic fluid from the cylinder on said side of the piston when the keel is away from its lowered position so that the keel can be prevented from moving toward the lowered position;

first regulating means for regulating the speed at which the keel can move toward the lowered position, and second regulating means for regulating the speed at which the keel can move toward the raised position;

wherein the second regulating means includes the cylinder being adapted to contain gas on the side of the piston opposite the side containing fluid for raising the keel and means for allowing said gas to escape from the cylinder at a predetermined rate when the keel is moving toward the raised position.

* * * * *